US009517489B2

(12) United States Patent
Fujioka et al.

(10) Patent No.: US 9,517,489 B2
(45) Date of Patent: Dec. 13, 2016

(54) OUTER PERIPHERY COATING METHOD OF HONEYCOMB STRUCTURE

(71) Applicant: NGK INSULATORS, LTD., Nagoya (JP)

(72) Inventors: Yasumasa Fujioka, Nagoya (JP); Jun Inoue, Nagoya (JP); Daisuke Miura, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 259 days.

(21) Appl. No.: 14/026,089

(22) Filed: Sep. 13, 2013

(65) Prior Publication Data

US 2014/0087080 A1 Mar. 27, 2014

(30) Foreign Application Priority Data

Sep. 25, 2012 (JP) ..... 2012-211516

(51) Int. Cl.

| | |
|---|---|
| ***B05D 1/42*** | (2006.01) |
| ***B05C 5/02*** | (2006.01) |
| ***B05C 11/04*** | (2006.01) |
| ***B28B 19/00*** | (2006.01) |
| *B05D 1/00* | (2006.01) |

(52) U.S. Cl.

CPC ..... *B05D 1/42* (2013.01); *B05C 5/0241* (2013.01); *B05C 5/0254* (2013.01); (Continued)

(58) Field of Classification Search

CPC ... B05D 1/0022; B05C 11/045; B05C 5/0241; B05C 5/0254

See application file for complete search history.

(56) References Cited

U.S. PATENT DOCUMENTS 7,588,716 B2 * 9/2009 Iwata ..... B28B 19/0038 264/630
2005/0249877 A1 * 11/2005 Noro ..... B05C 5/0208 427/289

(Continued)

FOREIGN PATENT DOCUMENTS

JP 2001314718 A * 11/2001
JP 2004-141708 A1 5/2004

(Continued)

OTHER PUBLICATIONS

European Examination Report (Application No. 13185506.6) dated Jan. 22, 2015.

(Continued)

*Primary Examiner* — Dah-Wei D Yuan
*Assistant Examiner* — Kristen A Dagenais
(74) *Attorney, Agent, or Firm* — Burr & Brown, PLLC

(57) ABSTRACT

An outer periphery coating method of honeycomb structure has coating steps where the honeycomb structure including a ring-like bulge portion is rotated; a coating member is brought into contact with a side surface of the honeycomb structure by pressing a side edge portion of a spatula via a rubber sheet, the coating member including the plate-like spatula in which a specific cut portion is formed in the one side edge portion and the side edge portion provided with the cut portion is an inclined surface inclined on a coating surface side, and the rubber sheet in which a cut is formed so that an end surface of the end portion is parallel to a back surface of the spatula when the end portion is bent along the side edge portion of the spatula; and a slurry coating material is supplied to the side surface of the honeycomb structure.

4 Claims, 14 Drawing Sheets

(52) U.S. Cl.
CPC ..... *B05C 11/045* (2013.01); *B28B 19/0038* (2013.01); *B05C 5/0291* (2013.01); *B05D 1/002* (2013.01); *B05D 2254/02* (2013.01)

(56) References Cited

U.S. PATENT DOCUMENTS

| | | | | |
|---|---|---|---|---|
| 2008/0268200 | A1 | 10/2008 | Domey et al. | |
| 2012/0032157 | A1 | 2/2012 | Kawabe et al. | |
| 2013/0025535 | A1* | 1/2013 | Choi | B05C 5/027 118/302 |

FOREIGN PATENT DOCUMENTS

| | | | |
|---|---|---|---|
| JP | 2005-125182 | A1 | 5/2005 |
| JP | 2010-525965 | A1 | 7/2010 |
| WO | 2008/136898 | A2 | 11/2008 |
| WO | 2011/066068 | A1 | 6/2011 |

OTHER PUBLICATIONS

Extended European Search Report (Application No. 13185506.6) dated Jan. 29, 2014.

* cited by examiner

OUTER PERIPHERY COATING METHOD OF HONEYCOMB STRUCTURE

The present application is an application based on JP-2012-211516 filed on Sep. 25, 2012 with the Japanese Patent Office, the entire contents of which are incorporated herein by reference.

BACKGROUND OF THE INVENTION

Field of the Invention

The present invention relates to an outer periphery coating method of honeycomb structure which can evenly coat a side surface of "a honeycomb structure having a ring-like bulge portion on an outer periphery" with a coating material.

Description of Related Art

Heretofore, honeycomb structures made of ceramic material have been used as diesel particulate filters (DPF), catalyst carriers or the like for use in an exhaust system of an exhaust gas of an engine or the like. Such ceramic honeycomb structures are prepared, for example, by coating an outer periphery of a bonded honeycomb segment assembly with a coating material.

Heretofore, for example, when an outer periphery of a columnar honeycomb structure is coated with a coating material, there has been used a method of leveling the coating material supplied to a side surface (an outer peripheral surface) by use of plate-like leveling means, or the like (e.g., see Patent Document 1). Moreover, there has also been disclosed a method of coating a side surface of a columnar honeycomb structure with a coating material by use of "a chamfering tool having a substantially flat central portion and both ends shaped" (e.g., see Patent Document 2).

On the other hand, a ceramic honeycomb structure provided with a ring-like bulge portion on an outer periphery has been disclosed (e.g., see Patent Document 3).

[Patent Document 1] JP-A-2004-141708

[Patent Document 2] JP-T-2010-525965

[Patent Document 3] JP-A-2005-125182

SUMMARY OF THE INVENTION

A bulge portion formed in a honeycomb structure disclosed in Patent Document 3 is formed by grind processing after coating, and it has been difficult to form the bulge portion at the coating step.

The bulge portion formed in the honeycomb structure disclosed in Patent Document 3 is constituted only of an outer periphery coating material. Therefore, when a height of the bulge portion increases, a thickness of the applied outer periphery coating material becomes uneven, and the bulge portion might peel off or fall off.

The present invention has been developed in view of the above problem, and a main object thereof is to provide an outer periphery coating method of honeycomb structure which can evenly coat a side surface of "the honeycomb structure having a ring-like bulge portion on an outer periphery, the bulge portion being formed into a tapered shape" with a coating material. The honeycomb structure includes the ring-like bulge portion, and hence when the structure is held in a metal container via a cushion material, the structure can effectively be prevented from being moved in the metal container in a diameter direction and a length direction.

To achieve the above object, according to the present invention, an outer periphery coating method of honeycomb structure is provided as follows.

According to one aspect of the present invention, an outer periphery coating method of honeycomb structure is provided, having coating steps of: rotating the columnar honeycomb structure as an object to be coated around a central axis; bringing a coating member including a plate-like spatula and a rubber sheet into contact with a side surface of the honeycomb structure; and supplying a slurry coating material to the side surface of the rotating honeycomb structure, to coat the side surface of the honeycomb structure with the coating material supplied to the side surface of the honeycomb structure by the rubber sheet of the coating member. The honeycomb structure includes a ring-like bulge portion formed into a ring shape along an outer peripheral direction on an outer periphery. The plate-like spatula has a coating surface as one surface and a back surface as the other surface, a cut portion having a shape along the shape of the ring-like bulge portion of the honeycomb structure is formed in one side edge portion, and the side edge portion provided with the cut portion is an inclined surface which is inclined on the side of the coating surface. In the rubber sheet, a cut is formed in an end portion so that an end surface of the end portion is parallel to the back surface of the spatula, when the rubber sheet is attached to the coating surface side of the spatula and the end portion of the rubber sheet is bent along the side edge portion of the spatula. In the step of bringing the coating member into contact with the side surface of the honeycomb structure, the side edge portion of the spatula is pressed onto the honeycomb structure via the rubber sheet, in a state where the side edge portion of the spatula is parallel to the central axis of the honeycomb structure and the end portion of the rubber sheet is bent along the side edge portion of the spatula, to bring the coating member into contact with the side surface of the honeycomb structure. In the step of supplying the slurry coating material to the side surface of the rotating honeycomb structure, the slurry coating material is supplied from a supply hole of a coating material supply unit disposed adjacent to the rubber sheet of the coating member.

According to a second aspect of the present invention, the outer periphery coating method according to the above first aspect is provided, wherein a hardness of the rubber sheet is from 30 to 90.

According to a third aspect of the present invention, the outer periphery coating method of honeycomb structure according to the above first or second aspects is provided, wherein an amount of the coating material to be supplied to the ring-like bulge portion of the honeycomb structure is larger than an amount of the coating material to be supplied to the side surface of the honeycomb structure excluding the ring-like bulge portion.

According to a fourth aspect of the present inventionl the outer periphery coating method of honeycomb structure according to any one of the above first to third aspects is provded, wherein the ring-like bulge portion of the honeycomb structure has a flat planar portion having a thickness smaller than that of the other portion, and a rotation speed of the honeycomb structure when the coating material is supplied to the planar portion is lower than a rotation speed of the honeycomb structure when the coating material is not supplied to the planar portion.

As described above, an outer periphery coating method of honeycomb structure of the present invention is a method of coating a side surface of the honeycomb structure with a coating material by use of a coating member including a plate-like spatula having a predetermined shape and a rubber sheet having a predetermined shape. The outer periphery coating method of honeycomb structure of the present invention is such a method, which can evenly coat the side surface of "the honeycomb structure having a ring-like bulge portion on an outer periphery" with the coating material.

DETAILED DESCRIPTION OF THE INVENTION

Embodiments of the present invention will specifically be described with reference to the drawings. The present invention is not limited to the following embodiments, and changes, modifications and improvements can be added without departing from the gist of the present invention.

Figure 13:
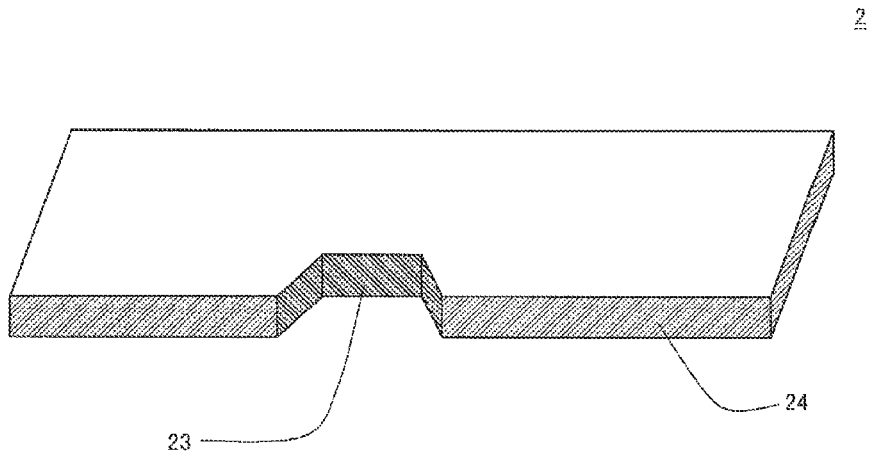
FIG. 13 is a perspective view schematically showing a plate-like spatula constituting the coating member for use in the coating steps in the one embodiment of the outer periphery coating method of honeycomb structure of the present invention.
Figure 14:
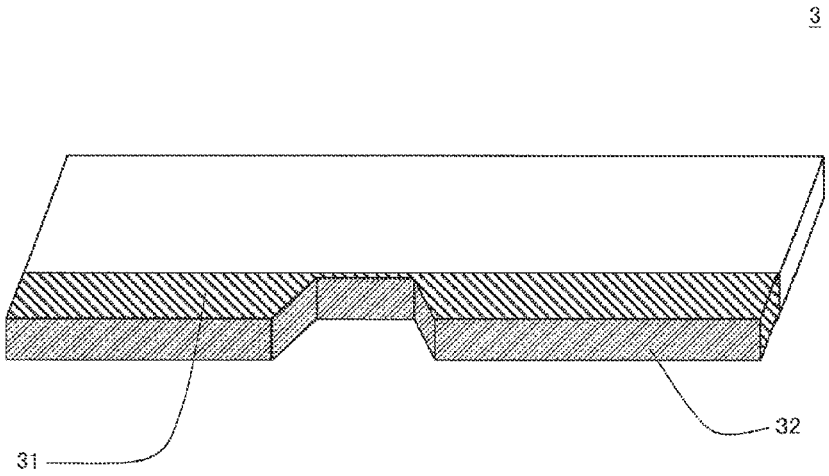
FIG. 14 is a perspective view schematically showing a rubber sheet constituting the coating member for use in the coating steps in the one embodiment of the outer periphery coating method of honeycomb structure of the present invention.

One embodiment of an outer periphery coating method of honeycomb structure of the present invention is a method having coating steps as shown in FIGS. 1 to 8. The coating steps are as follows. A columnar honeycomb structure 100 as an object to be coated is rotated around a central axis. A coating member 1 including a plate-like spatula 2 and a rubber sheet 3 is brought into contact with a side surface 104 of the honeycomb structure 100. Either of the rotation of the honeycomb structure 100 or the contact of the coating member 1 with the side surface 104 of the honeycomb structure 100 may first be started. Then, a slurry coating material is supplied to the side surface 104 of the rotating honeycomb structure 100. Then, the side surface 104 of the honeycomb structure 100 is coated with the coating material supplied to the side surface 104 of the honeycomb structure 100 by the rubber sheet 3 of the coating member 1. Here, the honeycomb structure 100 includes a ring-like bulge portion 101 formed into a ring shape along an outer peripheral direction R on an outer periphery. Furthermore, the plate-like spatula 2 has a coating surface 21 as one surface and a back surface 22 as the other surface. Moreover, in the plate-like spatula 2, a cut portion 23 having a shape along the shape of the ring-like bulge portion 101 of the honeycomb structure 100 is formed in one side edge portion 24. As shown in FIG. 13, the side edge portion 24 of the spatula 2 is a side surface portion of the spatula 2 "excluding the coating surface and the back surface". Moreover, "the cut portion 23 is formed in the one side edge portion 24". Specifically, as shown in FIG. 13, the cut portion 23 of the spatula 2 is "formed by cutting the one side edge portion 24 from a part thereof toward the inside". Furthermore, "the one side edge portion 24" of the spatula 2 is a portion corresponding to "one side of the coating surface (or the back surface)" in an outer peripheral portion of the spatula 2. Moreover, in the plate-like spatula 2, the side edge portion 24 provided with the cut portion 23 is an inclined surface which is inclined on the coating surface 21 side. Furthermore, the rubber sheet 3 is attached to the coating surface 21 side of the spatula 2. Additionally, in the rubber sheet 3, a cut 33 is formed in an end portion 31 so that "an end surface 32 of the end portion 31 is parallel to the back surface 22 of the spatula 2", when the end portion 31 (the end portion of the rubber sheet 3) is bent along the side edge portion 24 of the spatula 2. Moreover, in the rubber sheet 3, the cut 33 is preferably formed in the end portion 31 so that "the end surface 32 of the end portion 31 is present on about the same plane as the back surface 22 of the spatula 2 in parallel with the back surface of the spatula 2", when the end portion 31 is bent along the side edge portion 24 of the spatula 2. Here, as shown in FIG. 14, one end portion of the rubber sheet 3 in a width direction (the direction perpendicular to both a length direction and a thickness direction) is the end portion 31. Moreover, an end surface of the end portion 31 is the end surface 32. It is to be noted that there is not any special restriction on a region of the end portion 31 "in the width direction of the rubber sheet 3", but the region is at least a region which bends along the side edge portion 24 of the spatula 2. Moreover, there is not any special restriction on a length of the end portion 31 "in the width direction of the rubber sheet 3", and the length is, for example, from about 10 to 35% of a length of the rubber sheet 3 in the width direction. Then, the coating member 1 is brought into contact with the side surface 104 of the honeycomb structure 100 as follows. In a state where the side edge portion 24 of the spatula 2 is parallel to the central axis of the honeycomb structure 100 and the end portion 31 of the rubber sheet 3 is bent along the side edge portion 24 of the spatula 2, the side edge portion 24 of the spatula 2 is pressed onto the honeycomb structure 100 via the rubber sheet 3. In consequence, the coating member 1 is brought into contact with the side surface 104 of the honeycomb structure 100. When the slurry coating material is supplied to the side surface 104 of the rotating honeycomb structure 100, the slurry coating material is supplied from a supply hole 41 of a coating material supply unit 4 disposed adjacent to the rubber sheet 3 of the coating member 1.

Figure 1:
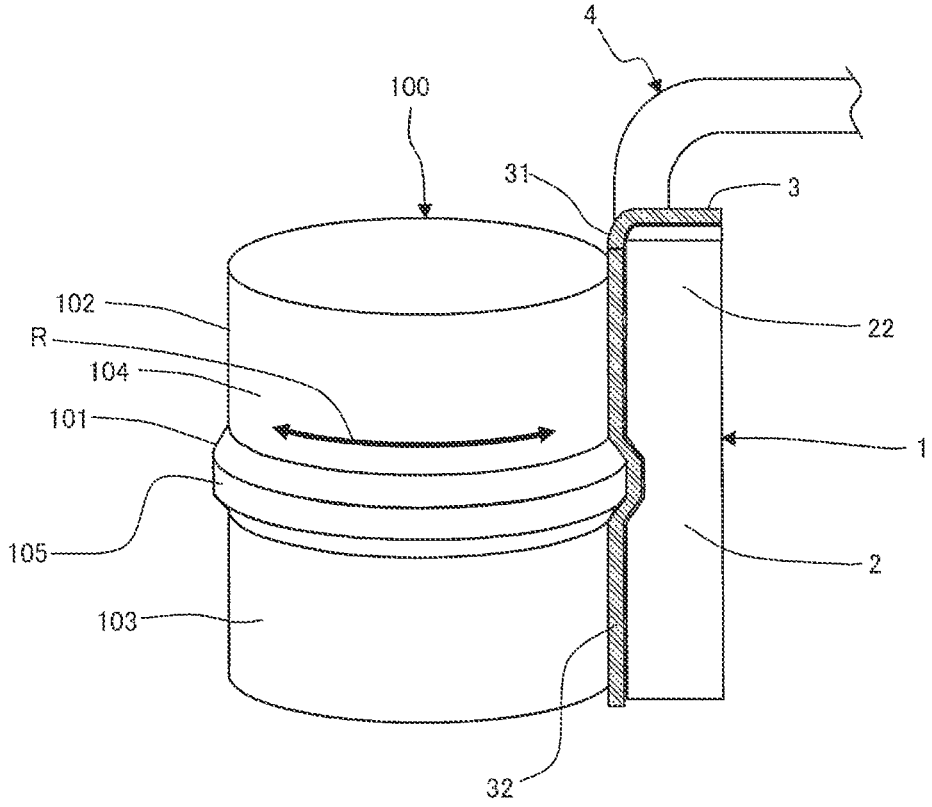
FIG. 1 is a perspective view schematically showing an arrangement of a honeycomb structure, a coating member and a coating material supply unit in coating steps of one embodiment of an outer periphery coating method of honeycomb structure of the present invention.
Figure 2:
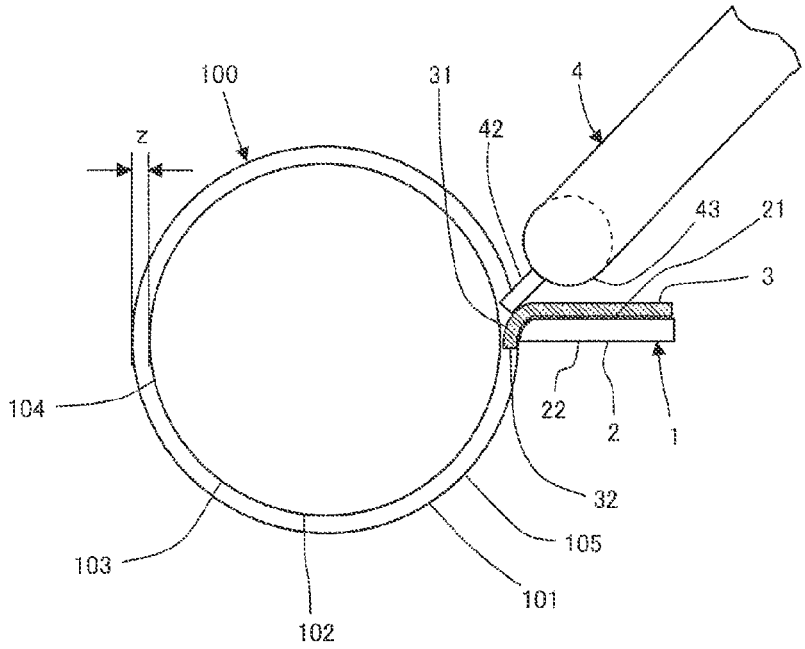
FIG. 2 is a plan view schematically showing the arrangement of the honeycomb structure, the coating member and the coating material supply unit in the coating steps of the one embodiment of the outer periphery coating method of honeycomb structure of the present invention.
Figure 3:
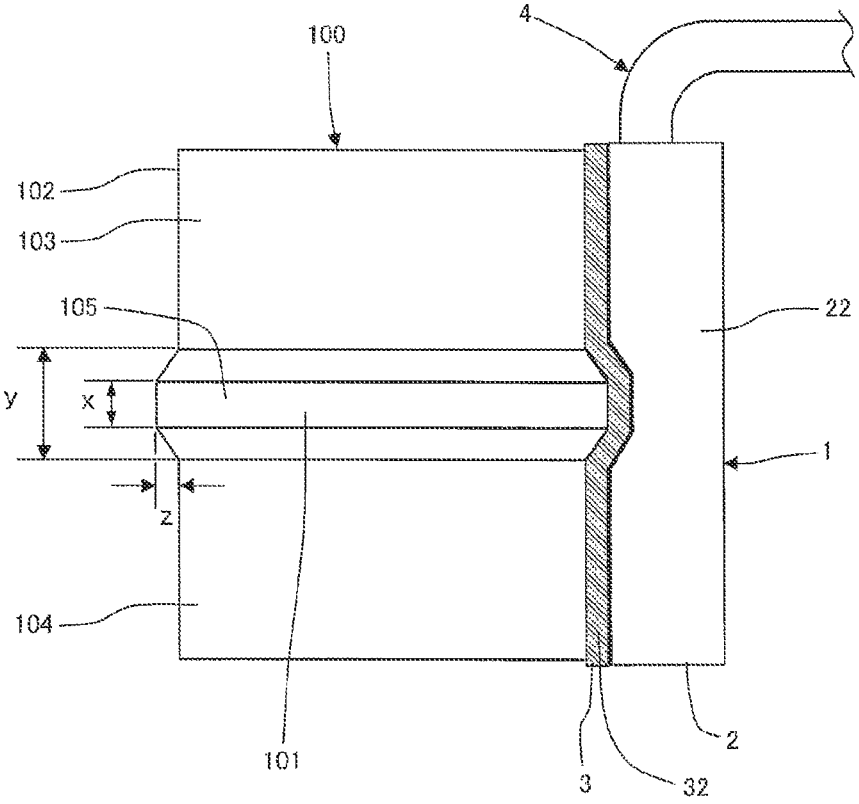
FIG. 3 is a side view schematically showing the arrangement of the honeycomb structure, the coating member and the coating material supply unit in the coating steps of the one embodiment of the outer periphery coating method of honeycomb structure of the present invention.
Figure 4:
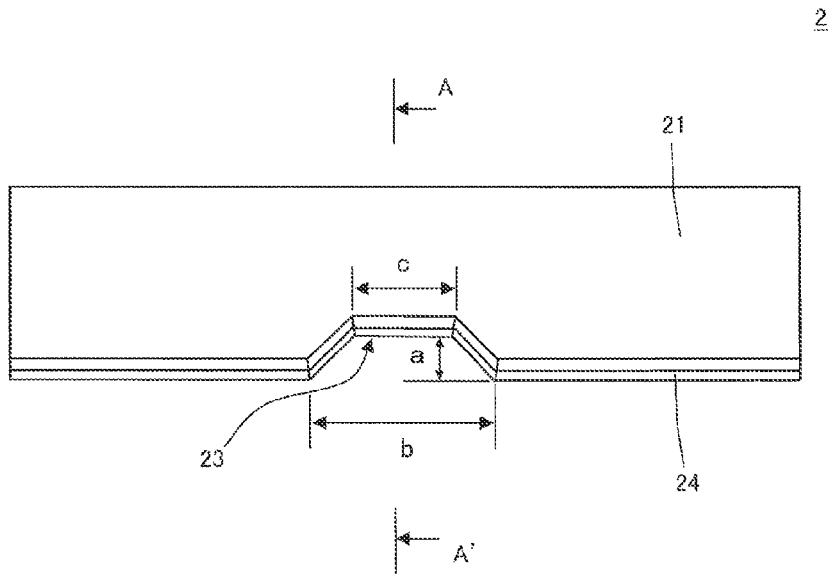
FIG. 4 is a plan view schematically showing a plate-like spatula constituting the coating member for use in the coating steps in the one embodiment of the outer periphery coating method of honeycomb structure of the present invention.
Figure 5:
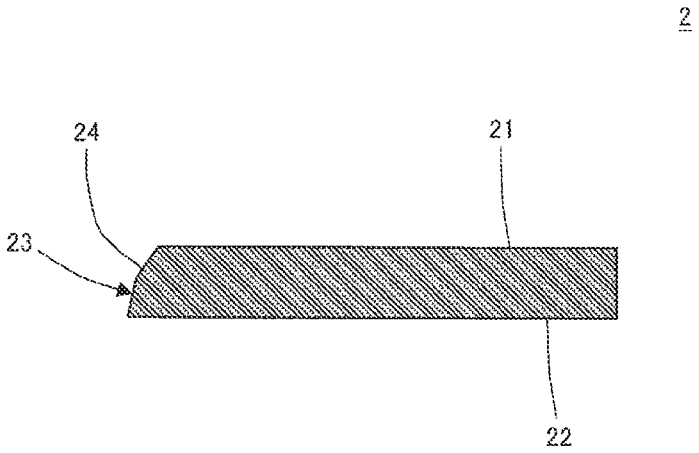
FIG. 5 is a schematic view showing a cross section cut along the A-A' line of FIG. 4.
Figure 6:
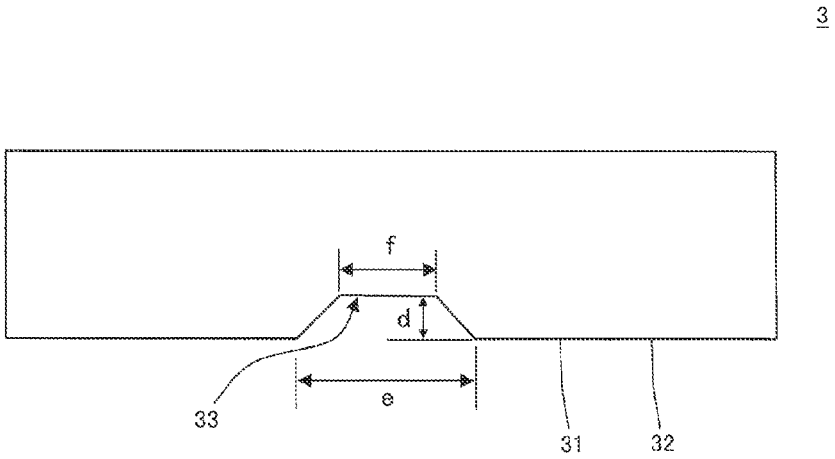
FIG. 6 is a plan view schematically showing a rubber sheet constituting the coating member for use in the coating steps in the one embodiment of the outer periphery coating method of honeycomb structure of the present invention.
Figure 7:
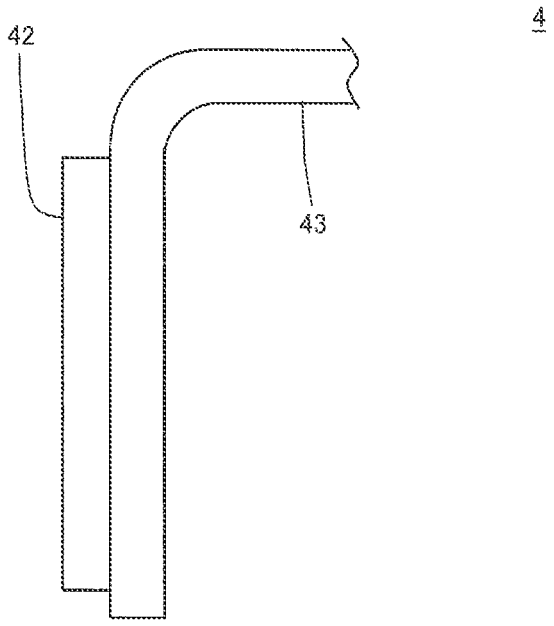
FIG. 7 is a side view schematically showing a coating material supply unit for use in the coating steps in the one embodiment of the outer periphery coating method of honeycomb structure of the present invention.
Figure 8:
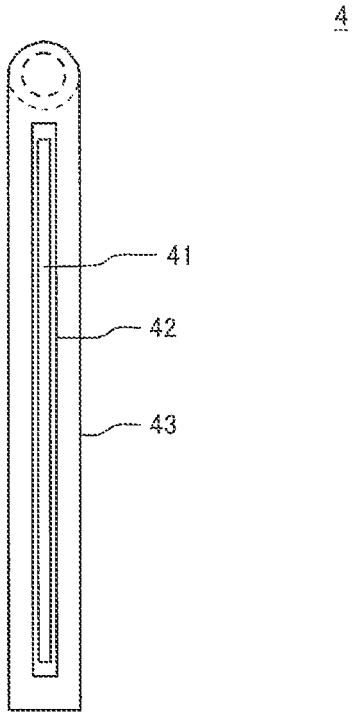
FIG. 8 is a front view schematically showing the coating material supply unit for use in the coating steps in the one embodiment of the outer periphery coating method of honeycomb structure of the present invention.

FIG. 1 is a perspective view schematically showing an arrangement of the honeycomb structure, the coating member and the coating material supply unit in the coating steps of one embodiment of the outer periphery coating method of honeycomb structure of the present invention. FIG. 2 is a plan view schematically showing the arrangement of the honeycomb structure, the coating member and the coating material supply unit in the coating steps of the one embodiment of the outer periphery coating method of honeycomb structure of the present invention. FIG. 3 is a side view schematically showing the arrangement of the honeycomb structure, the coating member and the coating material supply unit in the coating steps of the one embodiment of the outer periphery coating method of honeycomb structure of the present invention. FIG. 4 is a plan view schematically showing the plate-like spatula constituting the coating member for use in the coating steps in the one embodiment of the outer periphery coating method of honeycomb structure of the present invention. FIG. 5 is a schematic view showing a cross section cut along the A-A' line of FIG. 4, and is a schematic view showing the cross section of the plate-like spatula constituting the coating member for use in the coating steps in the one embodiment of the outer periphery coating method of honeycomb structure of the present invention. FIG. 6 is a plan view schematically showing the rubber sheet constituting the coating member for use in the coating steps in the one embodiment of the outer periphery coating method of honeycomb structure of the present invention. FIG. 7 is a side view schematically showing the coating material supply unit for use in the coating steps in the one embodiment of the outer periphery coating method of honeycomb structure of the present invention. FIG. 8 is a front view schematically showing the coating material supply unit for use in the coating steps in the one embodiment of the outer periphery coating method of honeycomb structure of the present invention. In FIGS. 1 and 2, partition walls of the honeycomb structure are omitted. FIG. 13 is a perspective view schematically showing a plate-like spatula constituting the coating member for use in the coating steps in the one embodiment of the outer periphery coating method of honeycomb structure of the present invention. FIG. 14 is a perspective view schematically showing a rubber sheet constituting the coating member for use in the coating steps in the one embodiment of the outer periphery coating method of honeycomb structure of the present invention.

The outer periphery coating method of honeycomb structure of the present embodiment has the above constitution, and hence the side surface of "the honeycomb structure having the ring-like bulge portion on the outer periphery" can be coated with the coating material so that a portion that is left uncoated is not generated. Moreover, the side surface of "the honeycomb structure having the ring-like bulge portion on the outer periphery" can evenly be coated with the coating material. When the outer periphery of the honeycomb structure including the ring-like bulge portion is coated with the coating material, some portions that are left uncoated (an uncoated state) are easily generated in the ring-like bulge portion. However, according to the outer periphery coating method of honeycomb structure of the present embodiment, such portions that are left uncoated (the uncoated state) can be eliminated.

The outer periphery coating method of honeycomb structure of the present embodiment has coating steps. The side surface of "the honeycomb structure having the ring-like bulge portion on the outer periphery" is coated with the coating material, to form an outer periphery coating wall. The outer periphery coating method of honeycomb structure of the present embodiment may have some steps other than the coating steps, but may only have the coating steps.

In the coating steps, "the columnar honeycomb structure 100, as the object to be coated, including the ring-like bulge portion 101 formed into the ring shape along the outer peripheral direction on an outer periphery 103" is rotated around the central axis. There is not any special restriction on a method of rotating the honeycomb structure 100, and a known method can be used. Moreover, the honeycomb structure 100 is preferably disposed so that the central axis is directed in a vertical direction.

A rotation speed of the honeycomb structure is preferably from 2 to 20 rpm, further preferably from 4 to 16 rpm, and especially preferably from 6 to 12 rpm. When the speed is lower than 2 rpm, the coating material may not be supplied to a lower inclined surface of the ring-like bulge portion. The coating material may drop down along the spatula, thereby generating some portions that are left uncoated. Moreover, a coating time lengthens, and productivity deteriorates sometimes. Here, when the honeycomb structure 100 including the ring-like bulge portion 101 on the outer periphery 103 is formed by grinding the honeycomb structure having a columnar shape, the partition walls are exposed to the outer periphery of the honeycomb structure 100 in the ground portion. Furthermore, when the rotation speed of the honeycomb structure is higher than 20 rpm, the partition walls in the outer periphery of the object to be coated cannot be coated with the coating material sometimes. In consequence, some space is made between each partition wall and the coating material, thereby causing strength deterioration of an outer peripheral portion of the object sometimes.

Then, the slurry coating material is supplied from the supply hole 41 of the coating material supply unit 4, in a state where the side edge portion 24 of the spatula 2 is pressed onto the honeycomb structure 100 "via the rubber sheet 3" to bring the coating member 1 into contact with the side surface 104 of the honeycomb structure 100. It is to be noted that from a viewpoint of preventing wear on the rubber sheet, the coating member is preferably brought into contact with the side surface 104 of the honeycomb structure 100, the coating material is supplied, and then the honeycomb structure 100 is rotated.

In the outer periphery coating method of honeycomb structure of the present embodiment, the coating member 1 includes the plate-like spatula 2, and the rubber sheet 3 attached to the coating surface 21 side of the spatula 2. Moreover, in the plate-like spatula 2, the cut portion 23 of the shape along the shape of the ring-like bulge portion 101 of the honeycomb structure 100 is formed in the one side edge portion 24. "A cut portion depth a" of the cut portion 23 is preferably from 75 to 125%, further preferably from 85 to 115%, and especially preferably from 95 to 105% of "a thickness (a height) z of the ring-like bulge portion 101". When the percentage is smaller than 75%, the coating material of a portion other than the ring-like bulge portion 101 on the side surface 104 of the honeycomb structure 100 thickens sometimes. When the percentage is larger than 125%, the ring-like bulge portion 101 is thickly coated with the coating material sometimes. The thickness z of the ring-like bulge portion 101 of the honeycomb structure 100 is a length of the ring-like bulge portion 101 in the diameter direction (a direction from the center of the honeycomb structure toward the outside) in a cross section perpendicular to the central axis. "A cut portion open width b" of the cut portion 23 is preferably from 90 to 110%, further preferably from 95 to 105%, and especially preferably from 97 to 103% of "a length of a portion" of the ring-like bulge portion 101 "which comes in contact with a honeycomb base material 102 in a central axis direction (an inner periphery width y of the ring-like bulge portion)". When the percentage is smaller than 90%, the coating material of the portion other than the ring-like bulge portion 101 on the side surface 104 of the honeycomb structure 100 thickens sometimes. When the percentage is larger than 110%, the ring-like bulge portion 101 is thickly coated with the coating material sometimes. "The cut portion open width b" is a length of an open area (an inlet area) of the cut portion 23 of the spatula 2 which opens in the outer peripheral portion. "A cut portion bottom width c" of the cut portion 23 is preferably from 90 to 110%, further preferably from 95 to 105%, and especially preferably from 97 to 103% of "a length of an outer periphery 105 of the ring-like bulge portion 101 in the central axis direction (an outer periphery width x of the ring-like bulge portion)". When the percentage is smaller than 90%, the ring-like bulge portion 101 is thickly coated with the coating material sometimes. When the percentage is larger than 110%, the ring-like bulge portion 101 is thickly coated with the coating material sometimes. "The cut portion bottom width c" is a length of the deepest portion of the cut portion 23 (a length of the "deepest portion" in a longitudinal direction).

In the outer periphery coating method of honeycomb structure of the present embodiment, in the plate-like spatula 2, the side edge portion 24 provided with the cut portion 23 is an inclined surface which is inclined on the coating surface 21 side. Here, "the inclined surface" means a planar inclined surface, a curved inclined surface, or a combination of these surfaces. Moreover, "the planar inclined surface, the curved inclined surface or the combination of these surfaces" has the following meaning. That is, this surface means one planar inclined surface, a combination of a plurality of planar surfaces, one curved inclined surface, a combination of a plurality of curved surfaces, or "a combination of one or more planar surfaces and one or more curved surfaces". Moreover, when the side edge portion 24 is constituted of a plurality of planar surfaces, a plurality of curved surfaces, or "a combination of the planar surface and the curved surface", the respective inclined surfaces are preferably arranged so that the planar surfaces, the curved surfaces or "the planar surfaces and the curved surfaces" are arranged in a direction from a coating surface side toward a back surface side. In this way, the side edge portion 24 of the plate-like spatula 2 is the inclined surface which is inclined on the coating surface side, and hence the end portion 31 of the rubber sheet 3 is easily bent along the side edge portion 24 of the spatula 2. In particular, the cut portion 23 of the side edge portion 24 of the plate-like spatula 2 is the inclined surface, and hence the end surface 32 of the end portion 31 of the rubber sheet 3 easily becomes parallel to the back surface 22 of the spatula 2. Here, when "the side edge portion 24 is the inclined surface which is inclined on the coating surface 21 side", it is meant that the side edge portion 24 is formed to incline toward the coating surface side. Moreover, "the side edge portion 24 inclines toward the coating surface" means that the side edge portion 24 inclines so that an area of the coating surface 21 decreases, when the coating surface is compared with the back surface. At this time, the spatula 2 has such a shape that "the side edge portion 24 (the inclined surface) is visible from the coating surface 21 side, but the side edge portion 24 (the inclined surface) is not visible from the back surface 22 side".

Moreover, there is not any special restriction on a size of the spatula 2. There is not any special restriction on a thickness of the plate-like spatula 2, but the thickness is preferably from 2 to 20 mm, further preferably from 4 to 18 mm, and especially preferably from 6 to 16 mm. When the thickness is smaller than 2 mm, the spatula 2 may easily be deformed. Therefore, the outer periphery of the honeycomb structure is not easily evenly coated with the coating material sometimes. When the thickness is larger than 20 mm, the spatula may not easily be disposed adjacent to the honeycomb structure. Moreover, it may be difficult to supply the coating material to a tip of the spatula (the side edge portion 24 provided with the cut portion 23). In the spatula 2, a length of the side edge portion provided with the cut portion (the length of the spatula 2 in the longitudinal direction) is preferably from 110 to 200%, further preferably from 120 to 180%, and especially preferably from 130 to 160% of a length of the honeycomb structure in the central axis direction. When the percentage is smaller than 110%, it is difficult to coat the whole honeycomb structure with the coating material, sometimes. When the percentage is larger than 200%, the operability deteriorates, and an extra space is required sometimes. Moreover, a length of the spatula 2 in a direction perpendicular to the thickness direction and the longitudinal direction (a width direction of the spatula 2) (the length of the spatula 2 in the width direction) is preferably from 200 to 1000%, further preferably from 300 to 800%, and especially preferably from 400 to 700% of "the cut portion depth a" of the spatula 2. When the percentage is smaller than 200%, it becomes difficult to fix the rubber sheet to the spatula, thereby making it difficult to evenly coat the outer periphery, sometimes. When the percentage is larger than 1000%, the operability deteriorates, and extra space is required sometimes. Here, "to evenly coat" the outer periphery means that the outer periphery is coated so that "an accumulated state" and "the uncoated state" are not generated. Moreover, a region "to be evenly coated" includes the whole side surface of the honeycomb base material and the whole surface of the ring-like bulge portion. "The accumulated state" is a state which might be generated in both the honeycomb base material and the ring-like bulge portion. In the honeycomb base material, "the accumulated state" means that a lower end of the honeycomb base material in the vertical direction is coated with the coating material which is 2 mm or more thicker than the coating material with which a central portion of the honeycomb base material in the vertical direction is coated. In the ring-like bulge portion, it is meant that a lower end of the ring-like bulge portion in the vertical direction is coated with the coating material which is 2 mm or more thicker than the coating material with which a central portion of the ring-like bulge portion in the vertical direction is coated. "The uncoated state" means a state where the surface of the honeycomb structure is exposed.

There is not any special restriction on a material of the spatula 2, but examples of the material include a stainless steel, a metal such as an aluminum alloy, and synthetic resin materials such as PE, PP and a nylon resin. Moreover, the spatula 2 preferably has a shape obtained by forming the inclined surface and the cut portion in a rectangular parallelepiped plate.

In the outer periphery coating method of honeycomb structure of the present embodiment, in the rubber sheet 3, the cut 33 is formed in the end portion 31 so that "the end surface 32 of the end portion 31 is parallel to the back surface 22 of the spatula 2, when the end portion 31 is bent along the side edge portion 24 of the spatula 2". Here, the state where "the end surface 32 of the end portion 31 is parallel to the back surface 22 of the spatula 2" means a state where the end surface 32 is completely parallel to the back surface 22, or the following state. That is, when all or part of the end surface 32 is distorted, and when the end surface 32 is not parallel to the back surface 22 or has a portion which is not parallel thereto, the end surface 32 is inclined to the back surface 22 in a range of an angle of 5° or less. The end surface 32 of the rubber sheet 3 is preferably a planar surface perpendicular to the front surface and back surface of the rubber sheet 3. Moreover, the rubber sheet 3 is preferably disposed on the coating surface 21 side of the spatula 2 so that "the end surface 32 of the end portion 31 is parallel to the back surface 22 of the spatula 2, when the end portion 31 is bent along the side edge portion 24 of the spatula 2". Furthermore, the rubber sheet 3 is preferably disposed on the coating surface 21 of the spatula 2 so that "one surface of the rubber sheet 3 comes in contact with (adjacent to) the coating surface 21 of the spatula 2". Additionally, a surface of the rubber sheet 3 on an opposite side to "a surface" of the rubber sheet "which faces the coating surface 21 side of the spatula 2" preferably comes in contact with the side surface 104 of the honeycomb structure 100.

"A cut depth d" of the cut 33 of the rubber sheet 3 is preferably from 20 to 100%, further preferably from 40 to 80%, and especially preferably from 50 to 70% of "the cut portion depth a" of the cut portion 23 of the spatula 2. When the percentage is smaller than 20%, it is difficult to obtain the state where "the end surface 32 of the end portion 31 of the rubber sheet 3 is parallel to the back surface 22 of the spatula 2" sometimes. When the percentage is larger than 100%, the ring-like bulge portion 101 is thickly coated with the coating material sometimes.

"A cut open width e" of the cut 33 of the rubber sheet 3 is preferably from 80 to 130%, further preferably from 90 to 120%, and especially preferably from 100 to 110% of "the cut portion open width b" (the length) of the cut portion 23 of the spatula 2. When the percentage is smaller than 80%, the whole side surface 104 of the honeycomb structure 100 is thickly coated with the coating material sometimes. When the percentage is larger than 130%, the ring-like bulge portion 101 is thickly coated with the coating material sometimes. "A cut bottom width f" of the cut 33 of the rubber sheet 3 is preferably from 20 to 80%, further preferably from 30 to 70%, and especially preferably from 40 to 60% of "the cut portion bottom width c" (the length) of the cut portion 23 of the spatula 2. When the percentage is smaller than 20%, the ring-like bulge portion 101 is thickly coated with the coating material sometimes. When the percentage is larger than 80%, the ring-like bulge portion 101 is thickly coated with the coating material sometimes.

Moreover, there is not any special restriction on a size of the rubber sheet 3. There is not any special restriction on a thickness of the rubber sheet 3, but the thickness is preferably from 1 to 4 mm, further preferably from 1.5 to 3.5 mm, and especially preferably from 2 to 3 mm. When the thickness is smaller than 1 mm, the rubber sheet 3 is easily deformed more than necessary. Therefore, the outer periphery of the honeycomb structure is not easily evenly coated with the coating material sometimes. When the thickness is larger than 4 mm, the rubber sheet 3 is not easily deformed, so that the outer periphery of the honeycomb structure is not easily evenly coated with the coating material sometimes. In the rubber sheet 3, a length of the end portion provided with the cut (the length of the rubber sheet 3 in the longitudinal direction) is preferably equal to the length of the side edge portion of the spatula 2 which is provided with the cut portion (the length of the spatula 2 in the longitudinal direction). Furthermore, a length of the rubber sheet 3 in a direction perpendicular to the thickness direction and the longitudinal direction (the width direction of the rubber sheet 3) (the length of the rubber sheet 3 in the width direction) is preferably from 60 to 150%, further preferably from 80 to 130%, and especially preferably from 100 to 110% of "the length of the spatula 2 in the width direction". When the percentage is smaller than 60%, the end portion 31 of the rubber sheet 3 is not easily bent along the side edge portion 24 of the spatula 2. When the percentage is larger than 150%, the outer periphery of the honeycomb structure is not easily evenly coated with the coating material sometimes. Additionally, the rubber sheet 3 preferably has a shape obtained by forming a cut in a rectangular parallelepiped (rectangular) sheet.

There is not any special restriction on a material of the rubber sheet 3, but examples of the material include a neoprene rubber, a natural rubber, a silicon rubber, and an urethane rubber. Hardness of the rubber sheet 3 is preferably from 30 to 90, further preferably from 40 to 80, and especially preferably from 50 to 70. When the hardness is smaller than 30, the rubber sheet 3 is easily deformed more than necessary, so that the outer periphery of the honeycomb structure is not easily evenly coated with the coating material sometimes. When the hardness is larger than 90, the rubber sheet 3 becomes rigid, thereby causing damage to the honeycomb structure sometimes. The hardness of the rubber sheet is a value measured by a method using "Durometer Type A" stipulated in ISO7619.

"A length of the end portion of the rubber sheet which projects from the back surface of the spatula, when the end portion of the rubber sheet is bent along the side edge portion of the spatula" (an amount of the projection of the end portion of the rubber sheet) is preferably from −2 to +2 mm, further preferably from −1 to +1 mm, and especially preferably 0 mm. When "the amount of the projection of the end portion of the rubber sheet" is a minus value, it is meant that the end portion of the rubber sheet does not reach the back surface of the spatula 2 (a dented state). When "the amount of the projection of the end portion of the rubber sheet" is smaller than −2 mm, the outer periphery of the honeycomb structure is not easily evenly coated with the coating material sometimes. When "the amount of the projection of the end portion of the rubber sheet" is larger than +2 mm, the outer periphery of the honeycomb structure is not easily evenly coated with the coating material sometimes. It is to be noted that when the rubber sheet is fixed to the spatula so that "the end surface of the end portion of the rubber sheet is positioned in the same plane as the back surface of the spatula, when the end portion of the rubber sheet is bent along the side edge portion of the spatula", the amount of the projection of the end portion of the rubber sheet is 0 mm.

In the outer periphery coating method of honeycomb structure of the present embodiment, the coating material supply unit 4 includes a supply tube 43 to transfer the coating material, and a supply nozzle 42 disposed in the supply tube 43 and provided with the supply hole 41. Moreover, the coating material supply unit 4 supplies the slurry coating material to the outer periphery of the honeycomb structure from the supply hole 41.

The supply nozzle 42 is preferably formed to extend along a length direction of the supply tube 43. Moreover, the coating material supply unit 4 is preferably disposed so that the longitudinal direction of the supply nozzle 42 is parallel to the central axis direction of the honeycomb structure. Moreover, when the coating material supply unit 4 is disposed adjacent to the rubber sheet of the coating member, an upper end of the supply nozzle 42 is preferably at a position of 10 to 30 mm from an upper end of the honeycomb structure to the upside in the vertical direction. Furthermore, a lower end of the supply nozzle 42 is preferably at a position of 0 to 20 mm from a lower end of the honeycomb structure to the downside in the vertical direction. It is to be noted that as to the above upper end and lower end, there is assumed a state where the central axis of the honeycomb structure and the longitudinal direction of the supply nozzle 42 are directed in the vertical direction.

There is not any special restriction on a material of the coating material supply unit 4, but examples of the material include a stainless steel and an aluminum alloy.

A discharge speed (a supply speed) of the coating material is preferably from 60 to 600 g/minute, further preferably from 200 to 500 g/minute, and especially preferably from 300 to 400 g/minute, when the coating material is discharged from the coating material supply unit 4. When the speed is lower than (smaller than) 60 g/minute, the coating material excessively decreases, so that the outer periphery of the honeycomb structure is not easily evenly coated with the coating material sometimes. When the speed is higher than (larger than) 600 g/minute, the coating material excessively increases, so that the outer periphery of the honeycomb structure is not easily evenly coated with the coating material sometimes.

Figure 11:
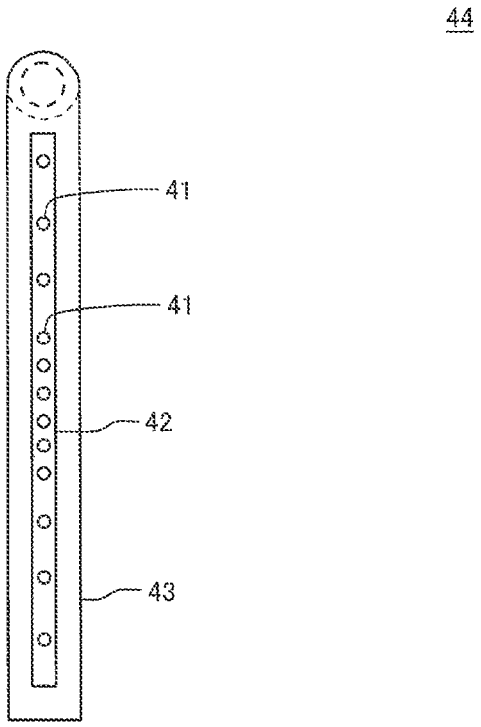
FIG. 11 is a front view schematically showing the coating material supply unit for use in coating steps in another embodiment of the outer periphery coating method of honeycomb structure of the present invention.

As shown in FIG. 8, the supply nozzle 42 is preferably provided with an elongate hole extending in the longitudinal direction. Furthermore, in the supply nozzle 42, as shown in FIG. 11, a plurality of holes are preferably arranged in the longitudinal direction, and formed so that the number of "the holes at positions to supply the coating material to the ring-like bulge portion" is increased. Consequently, it is possible to securely coat the ring-like bulge portion with the coating material. In consequence, in the outer periphery coating method of honeycomb structure of the present embodiment, an amount of the coating material to be supplied to the ring-like bulge portion of the honeycomb structure is preferably larger than an amount of the coating material to be supplied to the side surface of the honeycomb structure "excluding the ring-like bulge portion". In a coating material supply unit 44 shown in FIG. 11, round holes are formed in the supply nozzle 42. In the supply nozzle 42, an open area ratio by the hole at "the position to supply the coating material to the ring-like bulge portion" is preferably from 1.3 to 3.0 times an open area ratio by the hole at a position other than "the position to supply the coating material to the ring-like bulge portion". Moreover, the open area ratio by the hole at "the position to supply the coating material to the ring-like bulge portion" is further preferably from 1.5 to 3.0 times, and especially preferably from 1.5 to 2.0 times the open area ratio by the hole at the position other than "the position to supply the coating material to the ring-like bulge portion". When the ratio is smaller than 1.3 times, the coating material is not easily supplied to the ring-like bulge portion sometimes. When the ratio is larger than 3.0 times, the outer periphery of the honeycomb structure is not easily evenly coated with the coating material sometimes. FIG. 11 is a front view schematically showing the coating material supply unit for use in coating steps in another embodiment of the outer periphery coating method of honeycomb structure of the present invention.

Figure 12:
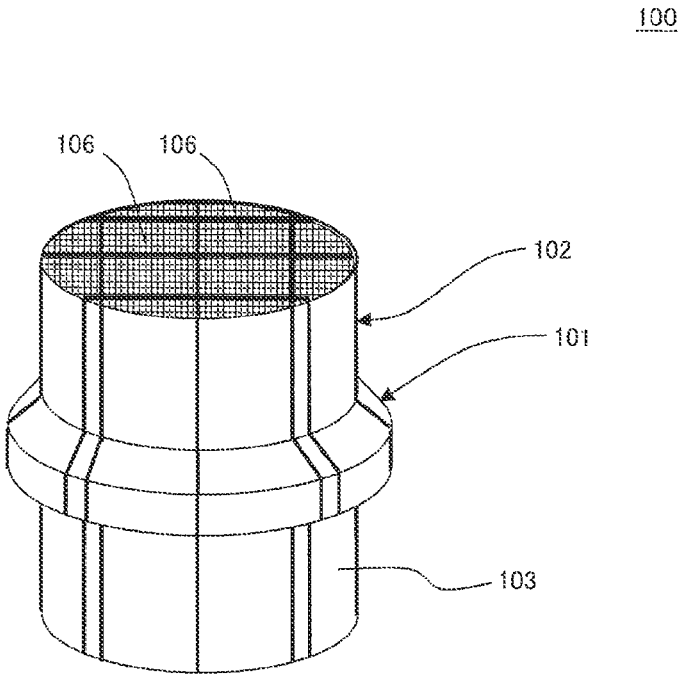
FIG. 12 is a perspective view schematically showing a honeycomb structure to be coated with the coating material by the one embodiment of the outer periphery coating method of honeycomb structure of the present invention.

In the outer periphery coating method of honeycomb structure of the present embodiment, the honeycomb structure 100 includes the ring-like bulge portion 101 formed into the ring shape along the outer peripheral direction on the outer periphery 103. The honeycomb structure 100 preferably includes the columnar honeycomb base material 102 having porous partition walls with which a plurality of cells extending from one end surface to the other end surface are formed to define through channels of a fluid, and the ring-like bulge portion 101 formed into the ring shape along the outer peripheral direction. Furthermore, as shown in FIG. 12, the honeycomb structure 100 is preferably a bonded honeycomb segment assembly. The bonded honeycomb segment assembly is formed by bonding side surfaces of a plurality of ceramic honeycomb segments 106 to one another by a bonding material. Moreover, the ring-like bulge portion 101 may be formed by bonding the plurality of ceramic honeycomb segments. Furthermore, both ends of the ring-like bulge portion 101 in the central axis direction are formed into a tapered state where an outer diameter of the ring-like bulge portion decreases toward a tip thereof. Additionally, there is not any special restriction on a material of the honeycomb structure 100 (the ceramic honeycomb segments 106), and example of the material include silicon carbide, a silicon-silicon carbide composite material, and silicon nitride. Moreover, there is not any special restriction on a material of the bonding material, but the material is preferably a ceramic material, and further preferably the same material as in the honeycomb structure 100 (the ceramic honeycomb segments 106). FIG. 12 is a perspective view schematically showing a honeycomb structure to be coated with the coating material by the one embodiment of the outer periphery coating method of honeycomb structure of the present invention.

Figure 9:
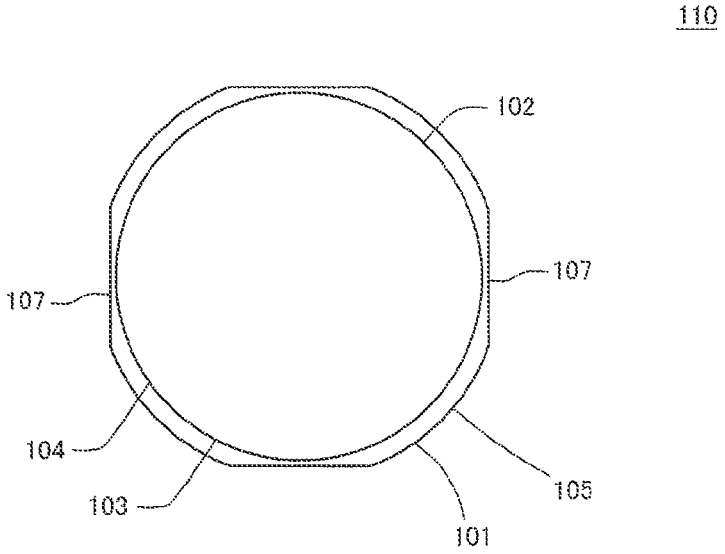
FIG. 9 is a plan view schematically showing the honeycomb structure to be coated with a coating material by the one embodiment of the outer periphery coating method of honeycomb structure of the present invention.
Figure 10:
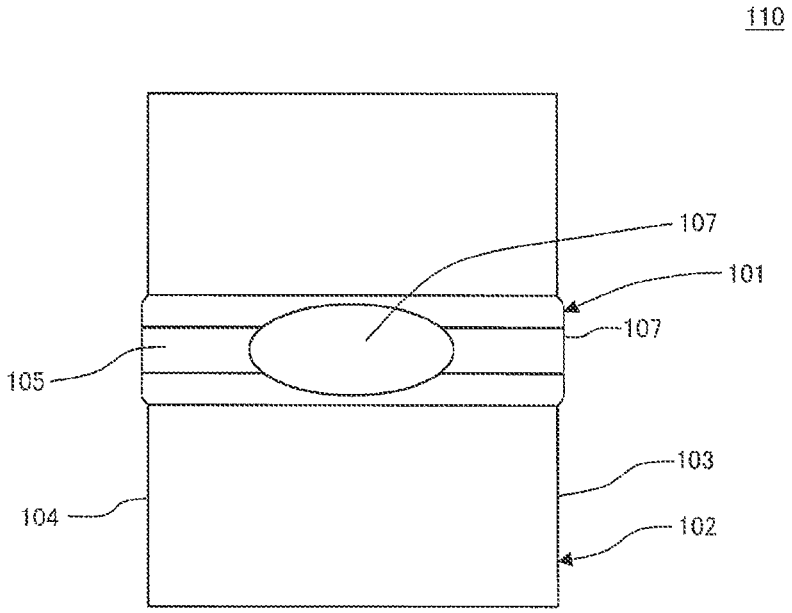
FIG. 10 is a front view schematically showing the honeycomb structure to be coated with the coating material by the one embodiment of the outer periphery coating method of honeycomb structure of the present invention.

As shown in FIGS. 9 and 10, a shape of the honeycomb structure may be such a shape that the ring-like bulge portion 101 is provided with "flat planar portions 107 each having a thickness smaller than the other portions (the other portions of the ring-like bulge portion)". In this case, it tends to be difficult to coat the planar portion 107 with the coating material. Therefore, when "the honeycomb structure including the ring-like bulge portion 101 provided with the planar portions 107" is coated, the rotation speed of the honeycomb structure is preferably lowered at the coating of the planar portion 107. That is, the rotation speed of the honeycomb structure at the coating of the planar portion 107 is preferably lower than a rotation speed of the honeycomb structure at the coating of the other circular portion. Moreover, it can be considered that the rotation speed of the honeycomb structure at the supply of the coating material to the planar portion is preferably lower than the rotation speed of the honeycomb structure when the coating material is not supplied to the planar portion. The rotation speed of the honeycomb structure at the coating of the circular portion other than the planar portion 107 is preferably from 1.5 to 10 times the rotation speed of the honeycomb structure at the coating of the planar portion 107. Moreover, the rotation speed of the honeycomb structure at the coating of the circular portion other than the planar portion 107 is further preferably from 3 to 8 times, and especially preferably from 5 to 6 times the rotation speed of the honeycomb structure at the coating of the planar portion 107. When the ratio is smaller than 1.5 times, the planar portions 107 are excessively coated with the coating material sometimes. When the ratio is larger than 10 times, the planar portions 107 are not easily evenly coated with the coating material sometimes. FIG. 9 is a plan view schematically showing the honeycomb structure to be coated with the coating material by the one embodiment of the outer periphery coating method of honeycomb structure of the present invention. In FIG. 9, the partition walls of the honeycomb structure are omitted. FIG. 10 is a front view schematically showing the honeycomb structure to be coated with the coating material by the one embodiment of the outer periphery coating method of honeycomb structure of the present invention.

The coating material is preferably a material obtained by adding an organic binder and/or an inorganic binder, and a dispersant and/or "a dispersion medium such as water" to ceramic powder of alumina, magnesia, titania, mullite, talc, silica, cordierite, SiC, or the like. The coating material is in the form of slurry. A viscosity of the coating material (25° C.) is from 80 to 180 dPa·s, further preferably from 100 to 160 dPa·s, and especially preferably from 120 to 140 dPa·s. When the value is smaller than 80 dPa·s, the viscosity is excessively low. Therefore, the outer periphery of the honeycomb structure is not easily evenly coated with the coating material sometimes. When the value is larger than 180 dPa·s, the viscosity is excessively high. Therefore, the outer periphery of the honeycomb structure is not easily evenly coated with the coating material sometimes. Moreover, there is not any special restriction on the material of the coating material, and the material can suitably be determined in accordance with a material, use application or the like of the honeycomb structure.

Moreover, when the honeycomb structure is coated with the coating material and dried, an outer periphery coating honeycomb structure can be obtained. Furthermore, the outer periphery coating honeycomb structure may be prepared by performing firing, after the honeycomb structure is coated with the coating material and dried. There is not any special restriction on drying conditions and firing conditions, and known conditions can be used. The outer periphery coating honeycomb structure is prepared by forming "an outer wall obtained by drying or firing the coating material" on the outer periphery of the honeycomb structure.

EXAMPLES

Hereinafter, the present invention will be described in more detail with respect to examples, but the present invention is not limited to these examples.

Example 1

A columnar honeycomb structure as an object to be coated which included a ring-like bulge portion formed into a ring shape along an outer peripheral direction on an outer periphery was coated with a coating material by use of a coating member including a plate-like spatula and a rubber sheet. The coating material was supplied to the outer periphery of the honeycomb structure by use of a coating material supply unit.

As the honeycomb structure, there was used a honeycomb structure which was a bonded honeycomb segment assembly shown in FIG. 12 and which had a shape including the ring-like bulge portion provided with planar portions as shown in FIGS. 9 and 10. A material of ceramic honeycomb segments was SiC. A length of the honeycomb structure in a central axis direction was 150 mm. Moreover, a diameter of each end surface of the honeycomb structure was 150 mm. Furthermore, a diameter of an outer periphery of the ring-like bulge portion of the honeycomb structure was 160 mm. Specifically, a thickness of the ring-like bulge portion of the honeycomb structure (a length in a diameter direction) was 5 mm. Moreover, a length of the outer periphery of the ring-like bulge portion of the honeycomb structure in the central axis direction was 15 mm. A length of a portion of the ring-like bulge portion of the honeycomb structure which came in contact with the honeycomb base material in the central axis direction was 40 mm.

As a spatula, a plate-like spatula of 240 mm (length)×30 mm (width)×10 mm (thickness) was used. A material of the spatula was duralumin. A cut portion was formed in the center of one side edge portion of the plate-like spatula which extended in a longitudinal direction. "A cut portion depth a" of the cut portion (see FIG. 4) was 5 mm. "A cut portion open width b" of the cut portion (see FIG. 4) was 40 mm. "A cut portion bottom width c" of the cut portion 23 (see FIG. 4) was 15 mm. Moreover, the side edge portion of the cut portion 23 was an inclined surface having an inclination angle of 20°. The inclined surface was a combination of one curved surface and three planar surfaces. As to an arrangement of the respective surfaces, the curved surface, the planar surface, the planar surface and the planar surface were arranged in order from a coating surface side toward a back surface side. A width of "the curved surface" (a length in "a thickness direction of the spatula") was 1.5 mm, and widths of the respective "planar surfaces" (lengths in "the thickness direction of the spatula") were 2.5 mm, 2.5 mm, and 3.5 mm, respectively. Moreover, a length of an arc of "the curved surface" was 4.2 mm, and lengths of oblique lines of the respective "planar surfaces" were 3.9 mm, 2.9 mm, and 3.6 mm, respectively. "The length of the arc of the curved surface" means a length of "the curved surface" (the length of a portion corresponding to the front surface) in a cross section of the spatula which is perpendicular to "a length direction". Moreover, "the length of the oblique line of the planar surface" means a length of "the planar surface" (the length of the portion corresponding to the front surface) in the cross section of the spatula which is perpendicular to "the length direction".

As the rubber sheet, a plate-like rubber sheet of 240 mm (length)×35 mm (width)×3 mm (thickness) was used. A material of the rubber sheet was a urethane rubber. A cut 33 was formed in the center of one side edge portion of a rubber sheet 3 which extended in the longitudinal direction (an end portion in a width direction) (see FIG. 6). "A cut depth d" of the cut 33 of the rubber sheet 3 (see FIG. 6) was 3.5 mm. "A cut open width e" of the cut 33 (see FIG. 6) was 45 mm. "A cut bottom width f" of the cut 33 (see FIG. 6) was 8 mm.

"An amount of projection of the end portion of the rubber sheet" (the rubber projection amount) was 0 mm. Moreover, a hardness of the rubber sheet was 60. The hardness of the rubber sheet was a value measured by a measuring method of "rubber hardness measurement" as follows.

There was used the coating material supply unit having a supply nozzle 42 "including a plurality of holes arranged in the longitudinal direction" and formed so that the number of "holes formed at positions to supply the coating material to the ring-like bulge portion" was increased as shown in FIG. 11. An open area ratio by the holes formed at "the positions to supply the coating material to the ring-like bulge portion" was 80%. Moreover, an open area ratio by the holes formed at positions other than "the positions to supply the coating material to the ring-like bulge portion" was 40%. Therefore, the open area ratio by the holes at "the positions to supply the coating material to the ring-like bulge portion" was 2.0 times the open area ratio by the holes at the positions other than "the positions to supply the coating material to the ring-like bulge portion". A length of the supply nozzle 42 in the longitudinal direction was 180 mm. Moreover, a length of the supply nozzle 42 in a width direction (a direction to discharge the coating material) was 20 mm. A material of the coating material supply unit was a stainless steel.

The honeycomb structure was coated with the coating material as follows.

First, the honeycomb structure was rotated around a central axis. The central axis of the honeycomb structure was directed in a vertical direction. Next, the coating member was disposed so that the side edge portion of the spatula (the side edge portion parallel to the longitudinal direction) was parallel to the central axis of the honeycomb structure. Then, the coating member was brought into contact with a side surface of the honeycomb structure by pressing the side edge portion of the spatula onto the honeycomb structure via the rubber sheet, in "a state where the end portion of the rubber sheet was bent along the side edge portion of the spatula". Then, the slurry coating material was supplied to the side surface of the rotating honeycomb structure from the supply hole of the coating material supply unit disposed adjacent to the rubber sheet of the coating member. Then, the side surface of the honeycomb structure was coated with the coating material supplied to the side surface of the honeycomb structure by the rubber sheet of the coating member. Additionally, a rotation speed of the honeycomb structure at the coating of a circular portion other than the planar portion of the ring-like bulge portion was 1.7 times a rotation speed of the honeycomb structure at the coating of the planar portion of the ring-like bulge portion. Moreover, a supply speed of the coating material was 400 g/minute.

As to the coated honeycomb structure, a coating state with the coating material was visually confirmed. The results are shown in Table 1. Moreover, by the above method, 100 honeycomb structures were coated with the coating material, and a yield was calculated. "The yield" is a ratio of the number of "the honeycomb structures having a suitable coating state with the coating material" to the number of all the prepared honeycomb structures.

In Table 1, a column of "rubber hardness" indicates the hardness of the rubber sheet. Moreover, a column of "coating material supply amount ratio" indicates the number of the times of the open area ratio by the holes at "the positions to supply the coating material to the ring-like bulge portion" to the open area ratio of the holes at the positions other than "the positions to supply the coating material to the ring-like bulge portion" in the supply nozzle of the coating material supply unit. Moreover, a column of "rotation speed ratio" indicates the number of the times of the rotation speed of the honeycomb structure at the coating of "the circular portion other than the planar portion of the ring-like bulge portion" to the rotation speed of the honeycomb structure at the coating of the planar portion of the ring-like bulge portion. Furthermore, a column of "rubber projection amount" indicates an amount of the projection of the end portion of the rubber sheet to project (the amount of the projection from the back surface).

(Rubber Hardness Measurement)

The hardness was measured in accordance with a method stipulated in ISO7619 by use of "Durometer Type A".

TABLE 1

| | Spatula cut portion | Rubber sheet cut | Rubber hardness | Coating material supply amount ratio | Rotation speed ratio | Rubber projection amount [mm] | Yield | Coating state |
|---|---|---|---|---|---|---|---|---|
| Example 1 | Present | Present | 60 | 2 | 1.7 | 0 | 100% | Suitable |
| Example 2 | | | 90 | 2 | 1.7 | 0 | 100% | Suitable |
| Example 3 | | | 70 | 1.5 | 1.5 | 0 | 100% | Suitable |
| Example 4 | | | 70 | 1.5 | 1.5 | −2 | 100% | Suitable |
| Example 5 | | | 70 | 1.5 | 1.5 | 2 | 100% | Suitable |
| Example 6 | | | 30 | 2 | 1.7 | 0 | 100% | Suitable (up to 50-th honeycomb structure) |
| Example 7 | | | 100 | 2 | 1.7 | 0 | 45% | Part of honeycomb structures broke at contact of each honeycomb structure with the rubber sheet |
| Example 8 | | | 70 | 1.2 | 1.5 | 0 | 65% | Part of honeycomb structures had portion uncoated with coating material |
| Example 9 | | | 70 | 1.5 | 1.2 | 0 | 60% | Part of honeycomb structures had portion uncoated with coating material |
| Example 10 | | | 70 | 1.5 | 1.5 | −3 | 40% | In part of honeycomb structures, thickness of coating material was non-uniform (streaks were generated) |
| Example 11 | | | 70 | 1.5 | 1.5 | 3 | 40% | In part of honeycomb structures, thickness of coating material was non-uniform (streaks were generated) |
| Comparative Example 1 | | None | 60 | 2 | 1.7 | 0 | 0% | Thickness of coating material on ring-like bulge portion increased |
| Comparative Example 2 | None | None | 60 | 2 | 1.7 | 0 | 0% | It was not possible to coat portion other than outer periphery of ring-like bulge portion with coating material |

Examples 2 to 11

The procedures of Example 1 were repeated except that respective conditions were changed as shown in Table 1, to coat each columnar honeycomb structure with a coating material. A coating state of each coated honeycomb structure with the coating material was visually confirmed in the same manner as in Example 1. The results are shown in Table 1.

Moreover, 50 honeycomb structures in total were coated with the coating material by the method of Example 6. Then, after coating the 50 honeycomb structures in total with the coating material, a state of the rubber sheet was confirmed.

Comparative Example 1

The procedures of Example 1 were repeated except that no "cut" was formed in a rubber sheet, to coat a columnar honeycomb structure with a coating material.

Comparative Example 2

The procedures of Example 1 were repeated except that no "cut" was formed in a rubber sheet and furthermore, no "cut portion" was formed in a spatula, to coat a columnar honeycomb structure with a coating material.

As seen from Table 1, in the case of a rubber hardness: 60, a coating material supply amount ratio: 2, a rotation speed ratio of 1.7 and a rubber projection amount of 0 mm (Example 1), it was possible to evenly perform coating with the coating material, and it was possible to obtain "a coating state (a state of the coating material with which the honeycomb structure was coated)" indicating an evenly coated surface. Moreover, to check an influence of the rubber hardness on the coating state, the coating with the coating material was performed on the same conditions as in Example 1 except that the rubber hardness was 90 (Example 2), and it was possible to obtain an evenly coated surface. Furthermore, the rubber hardness was changed to 70, and to check an influence of the coating material supply amount ratio and the rotation speed ratio, the coating material supply amount ratio was set to 1.5 and the rotation speed ratio was set to 1.5, to perform the coating (Example 3). Also in this example, it was possible to obtain an evenly coated surface. Additionally, to confirm an influence of "the rubber projection amount", the coating with the coating material was performed on the same conditions as in Example 3 except that "the rubber projection amount" was "−2 mm" (Example 4), and it was possible to obtain an evenly coated surface. Moreover, "the rubber projection amount" was changed to "+2 mm" to perform the coating with the coating material (Example 5), and it was possible to obtain an evenly coated surface.

Furthermore, the coating with the coating material was performed on the same conditions as in Example 1 except that the rubber hardness was changed to 30 (Example 6), and it was possible to obtain an evenly coated surface. Additionally, after coating the 50 honeycomb structures in total with the coating material, the rubber sheet was worn, and could not be used any more. The 51-st and subsequent honeycomb structures did not have the evenly coated surface, and deviated from a predetermined dimension.

Moreover, the coating was performed on the same conditions as in Example 1 except that the rubber hardness was changed to 100 (Example 7). When the rubber sheet came in contact with each honeycomb structure, substantially half of the honeycomb structures were broken. In consequence, a shape of an outer peripheral portion of each honeycomb structure changed, and it was not possible to obtain an evenly coated state. Furthermore, the coating was performed on the same conditions as in Example 3 except that the coating material supply amount ratio was 1.2 (Example 8). The coating material was not sufficiently supplied to the lower surface of the ring-like bulge portion of the honeycomb structure, thereby causing a case where "the honeycomb structure could not partially be coated with the coating material". Additionally, the coating with the coating material was performed on the same conditions as in Example 3 except that the rotation speed ratio was 1.2 (Example 9), thereby causing a case where "a part of the ring-like bulge portion of the honeycomb structure could not be coated with the coating material". Moreover, the coating with the coating material was performed on the same conditions as in Example 3 except that the rubber projection amount was "−3 mm" (Example 10), thereby causing a case where streak-like unevenness was made on the ring-like bulge portion of the honeycomb structure, and a shape of the obtained honeycomb structure deviated from a predetermined shape. Furthermore, the coating with the coating material was performed on the same conditions as in Example 3 except that the rubber projection amount was "+3 mm" (Example 11), thereby causing a case where streak-like unevenness was made on the ring-like bulge portion of the honeycomb structure, and a shape of the obtained honeycomb structure deviated from a predetermined shape.

Furthermore, in Comparative Example 1, no cut was formed in the rubber sheet. Therefore, in all the honeycomb structures, a thickness of coating of the ring-like bulge portion increased. All the honeycomb structures deviated from the predetermined shape. Also in Comparative Example 2, no "cut" was formed in the rubber sheet, and furthermore, no "cut portion" was formed in the spatula. Therefore, the spatula was disturbed by the bulge portion, and a portion other than the outer periphery of the ring-like bulge portion could not at all be coated.

An outer periphery coating method of honeycomb structure of the present invention can be utilized as a method in which a ceramic honeycomb structure for use as a diesel particulate filter (DPF), a catalyst carrier or the like for use in an exhaust system of an exhaust gas is coated with a coating material.

DESCRIPTION OF REFERENCE NUMERALS

1: coating member, 2: spatula, 3: rubber sheet, 4: coating material supply unit, 21: coating surface, 22: back surface, 23: cut portion, 24: side edge portion, 31: end portion, 32: end surface, 33: cut, 41: supply hole, 42: supply nozzle, 43: supply tube, 44: coating material supply unit, 100 and 110: honeycomb structure, 101: ring-like bulge portion, 102: honeycomb base material, 103: outer periphery, 104: side surface, 105: outer periphery of the ring-like bulge portion, 106: ceramic honeycomb segment, 107: planar portion, a: cut portion depth, b: cut portion open width, c: cut portion bottom width, d: cut depth, e: cut open width, f: cut bottom width, x: outer periphery width of the ring-like bulge portion, y: inner periphery width of the ring-like bulge portion, z: thickness of the ring-like bulge portion, and R: outer peripheral direction.

What is claimed is:

1. An outer periphery coating method of a honeycomb structure, having coating steps of: rotating a columnar honeycomb structure as an object to be coated around a central axis; bringing a coating member including a planar spatula and a rubber sheet into contact with a side surface of the honeycomb structure; and supplying a coating material slurry to the side surface of the rotating honeycomb structure, to coat the side surface of the honeycomb structure with the coating material supplied to the side surface of the honeycomb structure by the rubber sheet of the coating member, wherein the honeycomb structure includes an annular bulge portion formed along an outer peripheral direction on an outer periphery, the planar spatula has a coating surface as one surface and a back surface as the other surface, a cut portion having a shape along the shape of the annular bulge portion of the honeycomb structure is formed in one side edge portion, and the side edge portion provided with the cut portion is an inclined surface which is inclined on the side of the coating surface, in the rubber sheet, a cut is formed in an end portion so that an end surface of the end portion is parallel to the back surface of the spatula, when the rubber sheet is attached to the coating surface side of the spatula and the end portion of the rubber sheet is bent along the side edge portion of the spatula, in the step of bringing the coating member into contact with the side surface of the honeycomb structure, the side edge portion of the spatula is pressed onto the honeycomb structure via the rubber sheet, in a state where the side edge portion of the spatula is parallel to the central axis of the honeycomb structure and the end portion of the rubber sheet is bent along the side edge portion of the spatula, to bring the coating member into contact with the side surface of the honeycomb structure, in the step of supplying the coating material slurry to the side surface of the rotating honeycomb structure, the coating material slurry is supplied from a plurality of supply holes of a coating material supply unit disposed adjacent to the rubber sheet of the coating member, and an open area of supply holes corresponding in position to the annular bulge portion is 1.3 to 3.0 times greater than an open area of supply holes corresponding in position to the side surface of the honeycomb structure excluding the annular bulge portion, such that an amount of the coating material supplied to the annular bulge portion of the honeycomb structure is larger than an amount of the coating material supplied to the side surface of the honeycomb structure excluding the annular bulge portion.

2. The outer periphery coating method of a honeycomb structure according to claim 1, wherein a hardness of the rubber sheet is from 30 to 90.

3. The outer periphery coating method of a honeycomb structure according to claim 1, wherein the annular bulge portion of the honeycomb structure has a flat planar portion having a thickness smaller than that of the other portion, and a rotation speed of the honeycomb structure when the coating material is supplied to the planar portion is lower than a rotation speed of the honeycomb structure when the coating material is not supplied to the planar portion.

4. The outer periphery coating method of a honeycomb structure according to claim 2, wherein the annular bulge portion of the honeycomb structure has a flat planar portion having a thickness smaller than that of the other portion, and a rotation speed of the honeycomb structure when the coating material is supplied to the planar portion is lower than a rotation speed of the honeycomb structure when the coating material is not supplied to the planar portion.

* * * * *